US005522783A

United States Patent [19]

Gordon

[11] Patent Number: 5,522,783

[45] Date of Patent: Jun. 4, 1996

[54] ISOTONIC-ISOMETRIC DEVICE FOR EXERCISE AND PHYSICAL THERAPY

[75] Inventor: James R. Gordon, Benton, Ill.

[73] Assignee: Gordon Research & Development, Inc., Pinckneyville, Ill.

[21] Appl. No.: 364,280

[22] Filed: Dec. 27, 1994

[51] Int. Cl.[6] ..... A63B 21/045

[52] U.S. Cl. ..... 482/127; 482/129; 482/91; 482/123

[58] Field of Search ..... 482/33, 121, 122, 482/123, 127, 129, 91, 904, 130, 85, 87, 90

[56] References Cited

U.S. PATENT DOCUMENTS

| | | | |
|---|---|---|---|
| 3,246,893 | 4/1966 | Boggild et al. | 482/33 |
| 3,834,695 | 9/1974 | Boggild et al. | 482/33 |
| 3,942,790 | 3/1976 | Rice | 482/91 |
| 4,326,692 | 4/1982 | Loomer | 248/488 |
| 4,482,193 | 11/1984 | Boggs et al. | 305/51 |
| 4,620,704 | 11/1986 | Shifferaw | 482/130 |

FOREIGN PATENT DOCUMENTS

| | | | |
|---|---|---|---|
| 9113654 | 9/1991 | WIPO | 482/129 |

*Primary Examiner*—Lynne A. Reichard

*Attorney, Agent, or Firm*—Dorn, McEachran, Jambor & Keating

[57] ABSTRACT

This isometric/isotonic exercise and physical therapy device employs an elongated exercise rod preferably made of urethane or other resilient, elastomer resin. The exercise rod is releasably mounted, as by a set screw, in a socket that in turn is mounted on a metal base. The exercise rod may have one end secured in the socket; in other embodiments the socket is tubular and the elastomer rod extends through the tube. Different forms of mounting apparatus mount the base of the device on a stable support such as a floor, a desk, a table, a cabinet, a wall, a door, or a door frame. The base mounts include a vacuum cup for surface mounting, a clamp for a table or desk edge mount, and a floor-to-lintel doorway mount. The exercise/therapy use of the device depends on the resilient elastomer exercise rod; for a limp, low-resistance rod the exercise is essentially isotonic, but with stiffer rods isometric exercise is provided.

15 Claims, 3 Drawing Sheets

ISOTONIC-ISOMETRIC DEVICE FOR EXERCISE AND PHYSICAL THERAPY

BACKGROUND OF THE INVENTION

This invention is directed to a versatile device for isometric or isotonic exercise and physical therapy. The invention has many of the operational attributes of the exercise and physical therapy apparatus described and claimed in the applicant's co-pending application entitled "Exercise and Therapy Apparatus", filed concurrently herewith as Ser. No. 08/364,281, though the two are rather different in structure. This invention usually uses a solid or tubular urethane rod as the principal exercise element, but could utilize the adjustable elastomer torsion device described and claimed in the applicant's U.S. patent application Ser. No. 08/262,511 filed Jun. 20, 1994, now U.S. Pat. No. 5,417,407.

A wide variety of different mechanisms have been devised for use in physical therapy for various parts of the human anatomy. Typically, an impaired arm or wrist requires exercise or physical therapy to enable the impaired person to recover from the impairment. The same situation may apply to a leg, an ankle, a foot, or some other part of the human anatomy. For some impairments, particularly those involving broken bones, isometric exercises affording substantial resistance are preferred. In trainer's jargon, "no pain, no gain". For other impairments, usually those entailing muscular inflammation, near-zero resistance (isotonic) exercise is often deemed preferable. Many mechanisms can be used for both exercise and therapy purposes. It is difficult, if not impossible, to distinguish between their exercise and therapy attributes.

A principal problem with many exercise and physical therapy devices has been that the device usually is not sufficiently versatile to meet the numerous different physical problems to which human beings are prone and to provide either isotonic or isometric exercise for a given part of the human anatomy. Sometimes this problem is overcome, at least in part, by appropriate provision for changing the parts of a device to suit the needs of the person requiring exercise or physical therapy. Changeover of this kind may be difficult and time consuming. Furthermore, due to the wide disparity of individual humans as regards their physical attributes such as strength, weight, size, degree of impairment, etc., an apparatus that is quite appropriate and suitable for use by one individual may be totally unacceptable to another person having the same basic impairment, regardless of modification of the device. That is, a therapeutic exercise device may be lacking in the versatility necessary for conversion to use by different individuals even though those individuals have the same basic problem.

SUMMARY OF THE INVENTION

It is a principal object of the present invention, therefore, to provide a new and improved isotonic/isometric physical therapy and exercise device that can be readily adapted to a broad variety of individuals having quite different physical characteristics with only minimal modification of the device.

Another object of the invention is to provide a new and improved isotonic/isometric exercise and physical therapy device that provides for bending, twisting, and other exercises at a broad range of resistance levels with only minor modification of the device, while maintaining construction and use costs at a minimum.

Accordingly, the invention relates to a physical therapy and exercise device for use in the performance of bending exercises on a human anatomical part, particularly an arm. The device comprises a base, a socket affixed to the base, and an elongated resilient, bendable, twistable elastomer exercise rod (usually urethane) of predetermined length L fitted into and projecting from the socket. The device further comprises rod retainer means for releasably retaining the exercise rod in the socket; a set screw is preferred. Base mounting means are provided for mounting the base on a stable support such as a table, a desk, a cabinet, a wall, a door, or a door frame.

DESCRIPTION OF THE PREFERRED EMBODIMENTS

Figure 1:
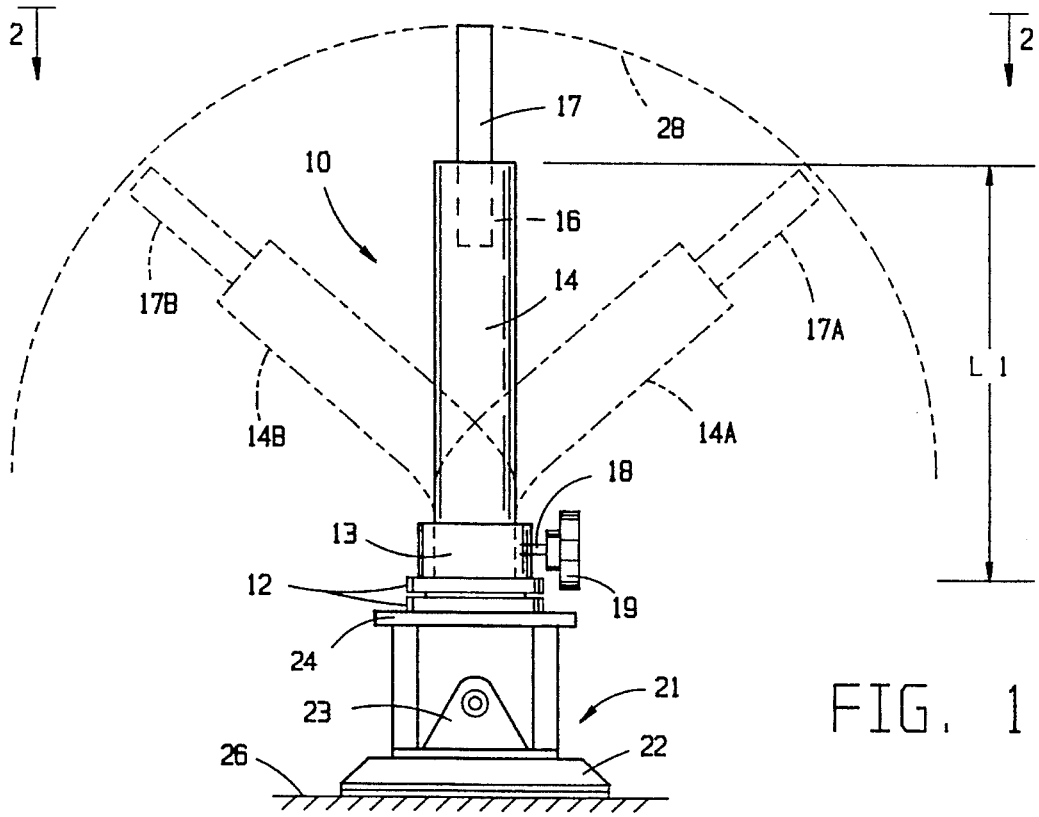
FIG. 1 is an elevation view of an isotonic/isometric exercise and therapy device constructed in accordance with one embodiment of the invention, using a suction cup mount.
Figure 2:
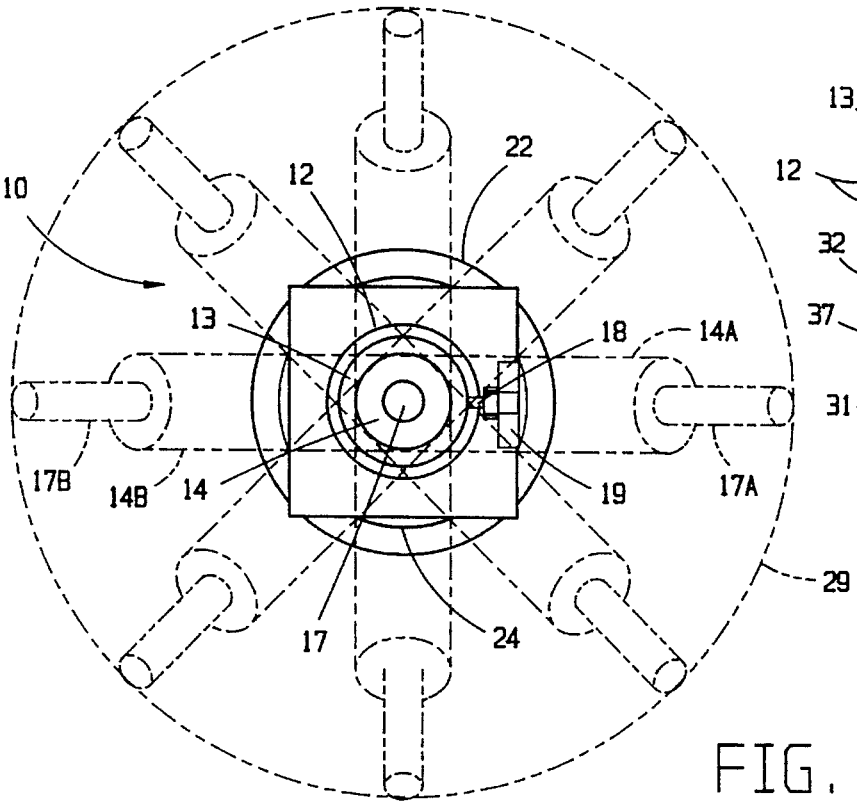
FIG. 2 is a plan view taken approximately as indicated by line 2—2 in FIG. 1.

FIGS. 1 and 2 afford an elevation view and a plan view, respectively, of an isotonic/isometric physical therapy and exercise device 10 constructed in accordance with a first preferred embodiment of the present invention. Device 10 includes a base 12 which, in this embodiment, includes a pair of rigid metal disks jointed to each other. A cylindrical socket 13 is affixed to the uppermost surface of base 12, in the illustrated orientation. Socket 13 may be formed of metal; the mounting arrangement used to affix socket 13 to base 12 is not critical to the present invention and may entail screws, welding, or any other appropriate mounting arrangement.

An elongated exercise rod 14 is releasably mounted in socket 13. Exercise rod 14 is of resilient, bendable, twistable elastomer construction; the exercise rod may be solid in cross section or may be tubular. The upper end of exercise rod 14, as seen in FIGS. 1 and 2, is equipped with a rigid handle 17 that projects outwardly beyond the length L1 of the exercise rod. Any desired material may be used for handle 17. In the specific construction shown in FIGS. 1 and 2 handle 17 is mounted in an aperture 16 in the outer end of rod 14. The end of exercise rod 14 that is mounted in socket 13, the lower end of the rod as seen in FIG. 1, is held in the socket by rod retainer means a set screw 18 that is threaded into an aperture in the wall of cylindrical socket 13 and that is equipped with a handle 19.

The physical therapy and exercise device 10 of FIGS. 1 and 2 further comprises a base mounting means 21 that is best illustrated in FIG. 1 but for which many components appear in FIG. 2. Base mounting means 21 includes a large vacuum cup 22 of conventional construction with an actuator 23 for the vacuum cup. A platform 24 is included in base mounting means 21; platform 24 is mounted on suction cup 22 by any desired structure and the base 12 of device 10 is affixed, by screws, welding, or other appropriate means, to the platform. With this construction, vacuum cup 22 can be utilized to mount device 10 on any stable support surface 26 (FIG. 1). In FIGS. 1 and 2 it is assumed that surface 26 is a horizontal surface but it could equally well be a vertical stable surface such as a wall or a door, or could have any other desired orientation.

Device 10, FIGS. 1 and 2, can be used for either isotonic or isometric exercises. A principal determining factor, with respect to the nature of the exercise employed, is the bending twisting resistance of exercise rod 14. If rod 14 is of relatively soft construction, such as a tubular urethane rod having a diameter of approximately 1.5 inches (4 cms) and a Shore A durometer rating of 45A through 95A, the exercise rod will have a low resistance and an exercise carried out with the device will be essentially isotonic. On the other hand, if rod 14 is substantially stiffer, as in the case of a solid urethane rod of the same cross-sectional dimension but having a Shore D rating of 45D through 70D, the exercise necessarily involves appreciable resistance to bending or twisting of the rod and hence is isometric in nature. In part, the isotonic or isometric character of the exercise is determined also by the length L1 of rod 14. If the length of exercise rod 14 is increased, it is easier to bend the rod and the exercise is more likely to be isotonic in character. For a relatively short length L1, rod 14 is quite stiff and exercise using the rod is more likely to be isometric.

Referring to FIG. 1, it is seen that rod 14 can be bent to the right to phantom position 14A by the user, employing handle 17, deflecting the handle to position 17A. In the opposite direction, rod 14 can be deflected to phantom position 14B by moving the handle to position 17B. The bend circle 28 in FIG. 1 shows the approximate limits of movement for the outer end of handle 17 in the course of deflection of rod 14 during physical therapy or exercise. The angular deflection of rod 14 is, of course, determined by the strength of the person carrying out the exercise and by the characteristics of rod 14.

FIG. 2 shows the same bend positions 14A and 14B for exercise rod 14, effected by deflection of the rod using handle 17. As is apparent from FIG. 2, however, there are numerous other positions to which rod 14 can be directed, in this instance by use of handle 17. The limits of these different positions are generally indicated by a bend circle 29. The orientation of bend circles 28 and 29 of FIGS. 1 and 2, respectively, is dependent upon whether device 10 is mounted on a horizontal surface such as a table or desk or on a vertical surface such as a wall or door.

To adapt device 10 for use by different individuals, who may have different impairments, it is a simple matter to change exercise rod 14. This is accomplished by releasing set screw 18; handle 19 is used for this purpose. A different exercise rod 14 (stiffer or more bendable, longer or shorter) can then be quickly substituted for the rod shown in FIGS. 1 and 2. The new exercise rod may have a greater or smaller length L1 and it may be formed from a stiffer or a less resistant material. The changeover of exercise rod 14 for adapting device 10 to use by a different person can be carried out in a matter of seconds.

Figure 2A:
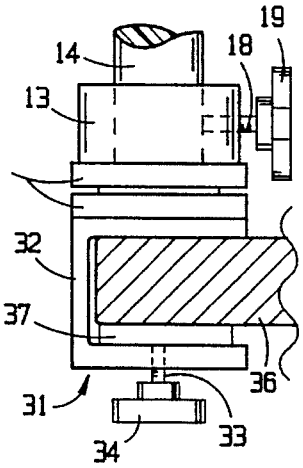
FIG. 2A illustrates a clamp mount for the device of FIG. 1.

FIG. 2A illustrates an alternative base mounting means 31 that may be used for device 10 of FIGS. 1 and 2. The alternative base mounting means 31 includes a C-shaped clamp 32 having the base 12 of the therapy device mounted on its upper surface. A set screw 33 is threaded through an aperture in the lower leg of clamp 32; a handle 34 on set screw 33 provides for tightening clamp 32 on the edge 36 of a stable support such as a desk, a table, or a cabinet. One or more shims 37 may be necessary or desirable to make sure that a tight, stable mount is effected on support 36.

Figure 4:
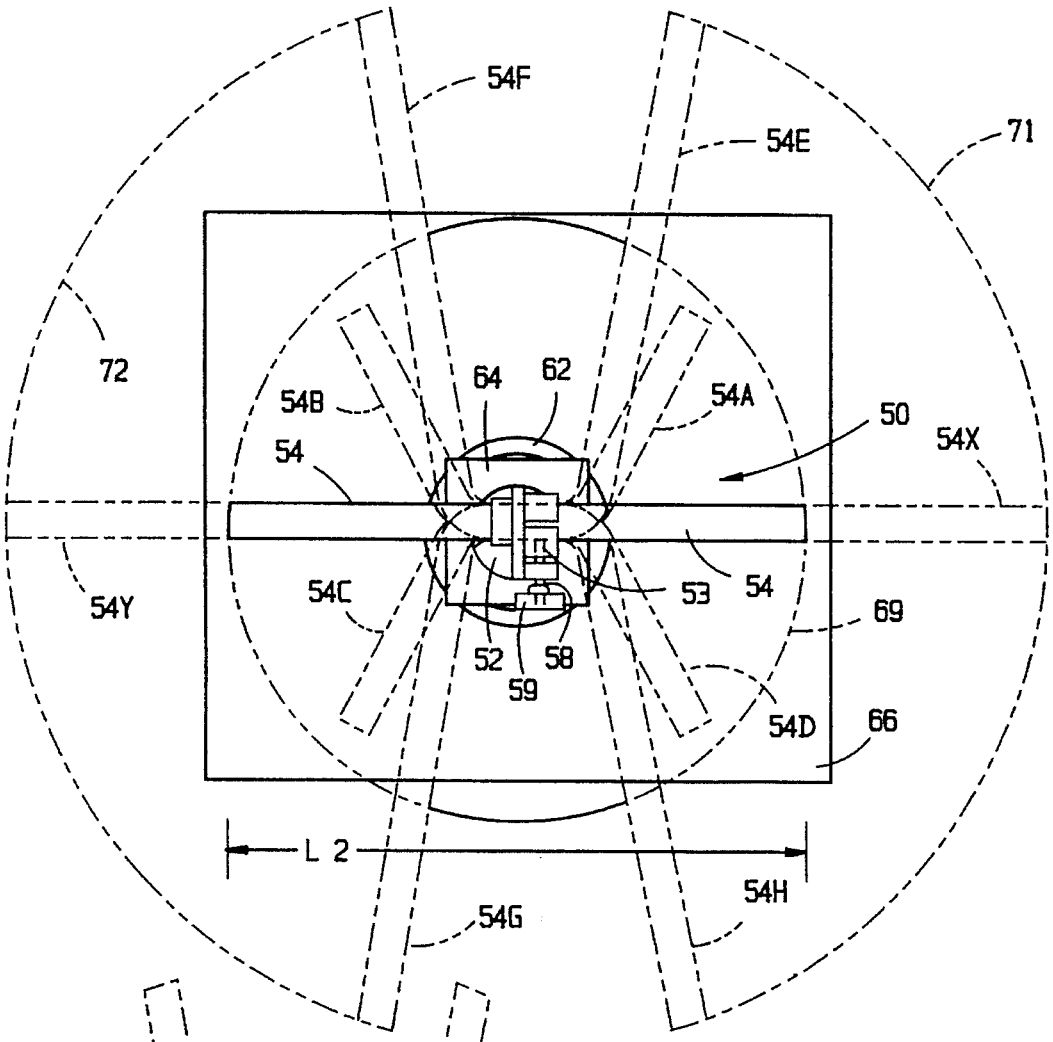
FIG. 4 is a plan view, like FIG. 2, the embodiment of the invention shown in FIG. 3.
Figure 3:
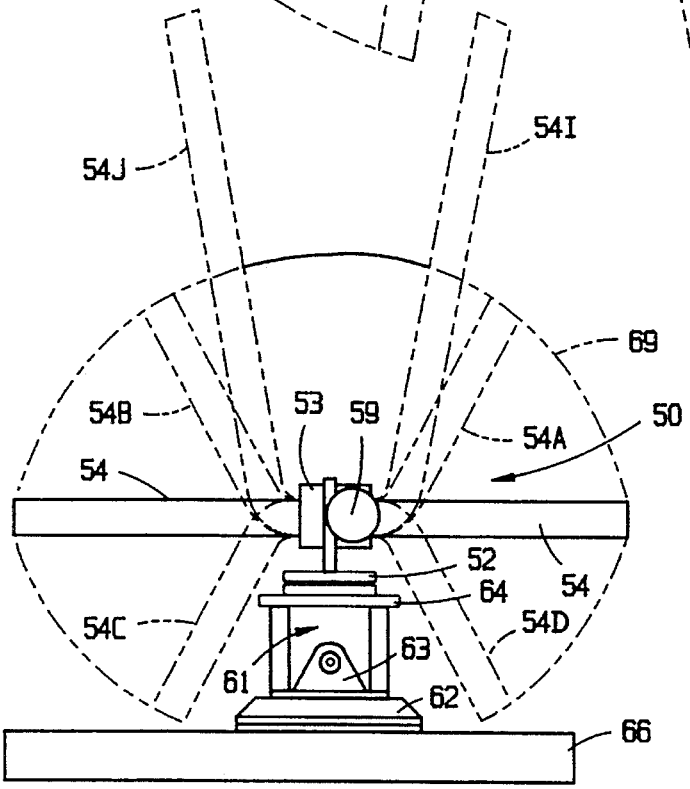
FIG. 3 is an elevation view, similar to FIG. 1, of another embodiment of the invention.

FIGS. 3 and 4, in views similar to FIGS. 1 & 2, respectively, illustrate an isotonic/isometric physical therapy and exercise device 50 constructed in accordance with another embodiment of the present invention. Device 50 includes a base 52 that may have the same construction as described above for base 12 in device 10. A socket 53 is affixed to base 52 and an elongated exercise rod 54 is mounted in the socket by appropriate means such as a rod retaining set screw 58 equipped with a handle 59. A major difference in device 50, as compared with device 10, is that exercise rod 54 extends completely through socket 53, which is basically tubular in configuration. That is, rod 54, which has a length L2, can be adjusted to project approximately equally from the opposite sides of socket 53. This is the relationship illustrated in solid lines in FIGS. 3 and 4. Another difference is that there are no handles on the outer ends of exercise rod 54. The user of device 50 grasps the exercise rod itself.

The base mounting means 61 for device 50 (FIGS. 3 and 4) includes a vacuum cup or suction cup 62, having an actuator 63, that is mounted on a platform 64 to which base 52 is affixed. Cup 62 mounts device 50 on a smooth stable surface 66. Thus, the base mounting arrangement for device 50 is essentially similar to that described above for device 10.

With exercise rod 54 in the position shown in solid lines in FIGS. 3 and 4, both ends of the rod can be bent and/or twisted. The available position range for the ends of the exercise rod is confined to a bend outline 69; typical positions for the exercise rod are indicated in FIGS. 3 and 4 by phantom outlines 54A, 54B, 54C, and 54D.

The exercise and physical therapy device 50 of FIGS. 3 and 4 is also subject to quite different use from that involved with bending of rod 54 within bend outline 69. Thus, handle 59 can be utilized to release set screw 58, permitting the user to slide rod 54 to the right, as seen in FIG. 4, so that the rod projects out to the phantom position 54X. With exercise rod 54 in this extended position, the limits of the bending range are the phantom line positions 54E and 54H of FIG. 4. That is, rod 54 can be deflected, by the person using it, throughout a bending arc 71. Conversely, with set screw 58 released, exercise rod 54 can be pulled fully to the left to phantom position 54Y of FIG. 4. With the exercise rod in this extended position, it can be bent through a range of positions from 54F to 54G, describing a bend arc 72. For hand and arm exercises, the positions in the range 54E–54H of FIG. 4 (bend arc 71) are most appropriate for exercise or physical therapy for an impaired right hand or arm. If the individual using the device has an impairment of the left arm or hand, the appropriate range is from position 54F to position 54G of FIG. 4, through bending arc 72. Vacuum cup 62 is effective to mount device 50 on any stable surface 66 such as a wall, a door, or the like.

FIG. 3 shows two additional maximum deflection positions 54I and 54J for exercise rod 54. Again, the extended position 54I is most likely to occur in a right-arm exercise; position 54J is most appropriate to a left-arm exercise.

Figure 5:
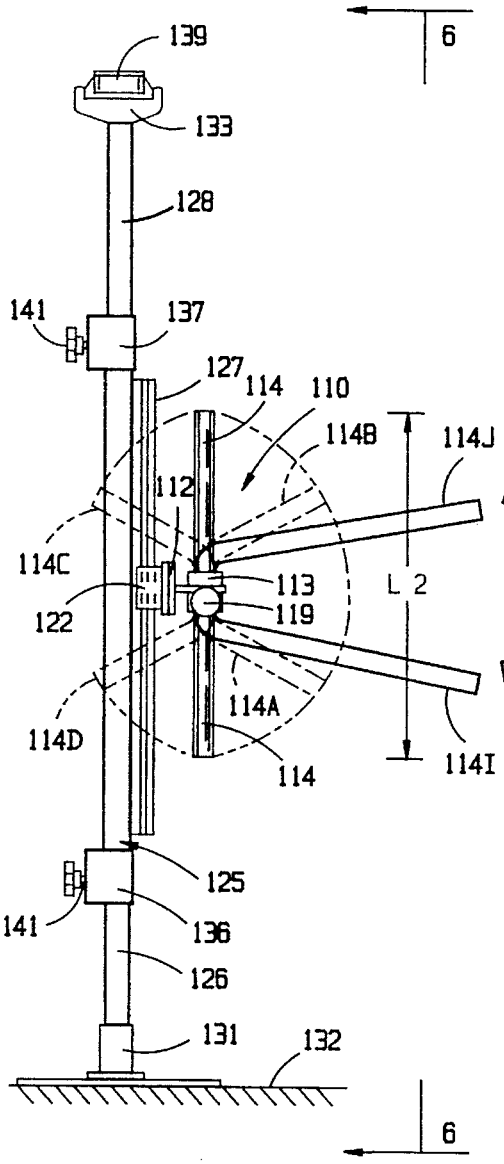
FIG. 5 is a side elevation view of a doorway-mounted embodiment of the invention.
Figure 6:
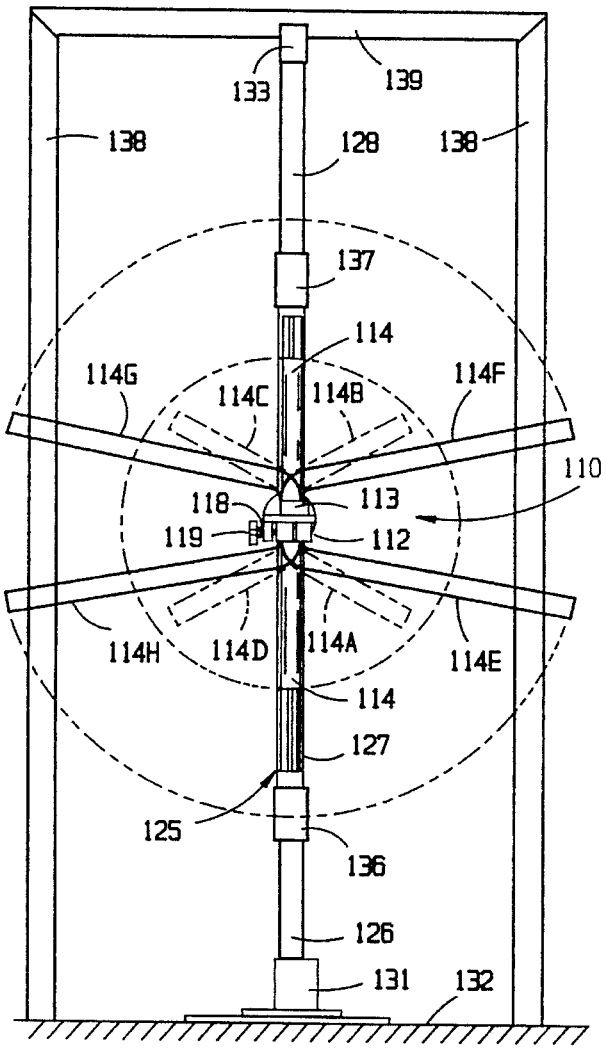
FIG. 6 is a front elevation view of the doorway mounted embodiment of FIG. 5, taken approximately along line 6—6 in FIG. 5.

FIGS. 5 and 6 illustrate another embodiment 110 of the invention. The isotonic/isometric physical therapy and exercise device 110 of FIGS. 5 and 6 includes a base 112 that is essentially the same as base 12 of device 10. A socket 113 is affixed to base 112 and an elongated resilient elastomer exercise rod 114 is mounted in and extends through socket 113. Rod 114 has a length L2; it has no handles. Rod 114 is held in socket 113 by a set screw or other retainer device 118 that is tightened or released by a handle 119. The side of base 112 opposite socket 113 is affixed to a clamp member 122 shown in FIG. 5.

Device 110 of FIGS. 5 and 6 includes an elongated rigid support member 125 that includes a first (lower) segment 126, a central track segment 127, and a third (upper) segment 128. The central segment 127 of support member 125 is joined to the top of the first segment 126 by a coupling 136. Similarly, the upper end of track segment 127 is connected to the third or upper portion of support member 125 by a coupling 137. The couplings or connectors 136 and 137 are each provided with a releasable retainer or set screw 141 so that device 110 can be dismantled and taken down conveniently. There is a pedestal 131 constituting a socket into which the lower segment 126 of support member 125 is inserted. Pedestal 131 is supported upon a floor 132 at the bottom of a door frame that includes two vertical side frame members 138 and a transverse lintel 139. A clamp 133 at the upper end of support segment 128 engages lintel 139 to retain the support member 125 in a vertical, erect position.

Socket 113 of device 110 is again of tubular construction so that exercise rod 114 can be extended through the socket. This is the condition shown in both of FIGS. 5 and 6, with the part of rod 114 above the socket 113 approximately the same length as the part below the socket. For this condition, exercise rod 114 can be bent to a variety of positions indicated by phantom outlines 114A, 114B, 114C, and 114D. On the other hand, exercise rod 114 can be pulled through socket 114 to extend almost entirely above or below the socket, simply by releasing set screw 118, using handle 119, and pulling the exercise rod to the desired extension. In its downwardly extended position, rod 114 can be deflected to a lower range of band positions 114E to 114H as shown in FIG. 6. With exercise rod 114 extended above socket 113 to approximately its maximum length, the range of operational positions for the rod is between phantom positions 114F and 114G in FIG. 6. The bend projection locations of rod 114 outwardly of socket 113, with the rod extended to its extremes below and above the socket, are shown by phantom outlines 114I and 114J, respectively, in FIG. 5.

The basic operation of physical therapy and exercise device 110 of FIGS. 5 and 6 is essentially the same as for the previously described embodiments and hence need not be repeated. In this instance, however, the slide clamp 122 (FIG. 5) on which base 112 and other components of device 110 are mounted can be moved upwardly and downwardly along on the central track segment 127 of support 125 to meet the needs of tall or short users or to accommodate wheelchair users. In all other respects, device 110 functions in essentially the same way as other embodiments described above.

From the foregoing description it will be apparent that the exercise and physical therapy devices of the invention are readily, easily, and quickly adaptable to a broad variety of individuals having quite different physical characteristics without requiring substantial modification of the apparatus. The invention can be used to meet virtually any exercise or therapy requirement for bending with respect to various anatomical parts (e.g., a hand, a wrist or an arm). If an exercise rod is too stiff or too compliant to fit the needs of an individual user (or therapist) it is a simple matter to release the set screw holding the exercise rod and to replace that rod with another that has the desired compliance/resistance characteristic. Construction and use costs, in any of the described embodiments, are effectively minimized; versatility and adaptability are maximized.

I claim:

1. A physical therapy and exercise device for use in the performance of exercises on a human anatomical part, the device comprising:

a base;

a socket affixed to the base;

an elongated resilient, bendable, twistable elastomer exercise rod for exercise of a human anatomical part, of predetermined length L, fitted into and projecting from the socket;

rod retainer means for releasably retaining the exercise rod in the socket; and base mounting means for mounting the base on a fixed stable support such as a table, a desk, a cabinet, a wall, a door, or a door frame.

2. A physical therapy and exercise device according to claim 1 in which the base mounting means comprises a vacuum suction cup for mounting the base on a support such as a table, a desk, a wall, or a door.

3. A physical therapy and exercise device according to claim 1 in which the base mounting means comprises a clamp for mounting the base on the edge of a support such as a table, a desk, or a cabinet.

4. A physical therapy and exercise device according to claim 1 in which the base mounting mounts the device in a doorway and in which the mounting means comprises:

an elongated rigid support member including three interconnected segments, the three segments comprising, in series, a first segment, a central track segment, and a third segment;

a pedestal engaging the end of the first segment opposite the interconnection of the first segment to the central track segment;

a clamp mounted on the end of the third segment opposite the interconnection of the third segment to the central track segment;

and track mounting means connecting the base to the central track segment.

5. A physical therapy and exercise device according to claim 4 in which:

the pedestal rests on a floor beneath a doorway;

the clamp engages the lintel portion of a doorway;

and in which the mounting means further comprises a releasable latch for latching the base at any of a plurality of positions on the central track segment.

6. A physical therapy and exercise device according to claim 1 in which the exercise rod is formed of a resilient elastomer resin.

7. A physical therapy and exercise device according to claim 6 in which the resin is urethane.

8. A physical therapy and exercise device according to claim 1 in which the device further comprises a handle affixed to and projecting coaxially from an end of the exercise rod displaced from the socket.

9. A physical therapy and exercise device according to claim 1 in which one end of the exercise rod is mounted in the socket and the other end of the rod is displaced from the socket by a distance less than L.

10. A physical therapy and exercise device according to claim 1 in which the socket is a short, cylindrical tube open at both ends and in which the exercise rod extends through the socket.

11. A physical therapy and exercise device according to claim 1 in which the rod retainer means is a set screw threaded into the socket and engaging the surface of the exercise rod.

12. A physical therapy and exercise device exercise of a human anatomical part comprising an elongated, resilient, bendable, and twistable elastomer rod of predetermined length, the rod having a diameter in a range of 2.5 to 6.5 centimeters and having a durometer hardness, on a Shore A scale, in the range of 45 to 95.

13. A physical therapy and exercise device according to claim 12 in which the length of the rod is in a range of 15 to 100 centimeters.

14. A physical therapy and exercise device according to claim 12 in which the rod is tubular.

15. A physical therapy and exercise device according to claim 12 in which the rod is formed of elastomeric urethane resin.

* * * * *